US010300514B2

(12) United States Patent
Pozzo

(10) Patent No.: US 10,300,514 B2
(45) Date of Patent: May 28, 2019

(54) ROLLING STATION AND ROLLING MILL PLANT

(71) Applicant: PMP INDUSTRIES S.P.A., Coseano (UD) (IT)

(72) Inventor: Luigino Pozzo, Coseano (UD) (IT)

(73) Assignee: PMP INDUSTRIES S.P.A., Coseano (UD) (IT)

( * ) Notice: Subject to any disclaimer, the term of this patent is extended or adjusted under 35 U.S.C. 154(b) by 750 days.

(21) Appl. No.: 14/434,660

(22) PCT Filed: Oct. 21, 2013

(86) PCT No.: PCT/EP2013/003157

§ 371 (c)(1),
(2) Date: Apr. 9, 2015

(87) PCT Pub. No.: WO2014/063803

PCT Pub. Date: May 1, 2014

(65) Prior Publication Data

US 2015/0273549 A1 Oct. 1, 2015

(30) Foreign Application Priority Data

Oct. 24, 2012 (IT) ..... UD2012A0178

(51) Int. Cl.

| | |
|---|---|
| ***B21B 35/04*** | (2006.01) |
| ***B21B 37/46*** | (2006.01) |
| ***B21B 35/14*** | (2006.01) |
| ***B21B 1/22*** | (2006.01) |
| ***B21B 31/02*** | (2006.01) |
| ***B21B 35/06*** | (2006.01) |

(Continued)

(52) U.S. Cl.

CPC ..... *B21B 37/46* (2013.01); *B21B 1/22* (2013.01); *B21B 31/02* (2013.01); *B21B 35/04* (2013.01); *B21B 35/06* (2013.01); *B21B 35/141* (2013.01); *B21B 37/52* (2013.01); *B21B 1/18* (2013.01); *B21B 35/14* (2013.01); *B21B 2265/24* (2013.01); *B21B 2267/065* (2013.01)

(58) Field of Classification Search

CPC ..... B21B 35/12; B21B 35/04; B21B 35/06; B21B 35/14; B21B 37/46; B21B 37/52; B21B 1/22; B21B 31/02; B21B 35/10; B21B 35/141

USPC ..... 72/249

See application file for complete search history.

(56) References Cited

U.S. PATENT DOCUMENTS 3,172,313 A * 3/1965 Fox ..... B21B 35/06 100/172

4,299,103 A * 11/1981 Marten ..... B21B 1/22 72/11.8

(Continued)

*Primary Examiner* — Debra M Sullivan

(74) *Attorney, Agent, or Firm* — Egbert, McDaniel & Swartz, PLLC

(57) ABSTRACT

Rolling station intended to couple with a respective rolling cartridge or stand provided with two rolling cylinders, wherein the rolling station has a supporting frame of the transmissions suitable for housing a pair of transmission devices of which a first transmission device is intended to couple with a first rolling cylinder and a second transmission device is intended to couple with a second rolling cylinder, the first rolling cylinder being put in rotation by a first motor via the first transmission device and the second rolling cylinder being put in rotation by a second motor via the second transmission device.

16 Claims, 13 Drawing Sheets

(51) Int. Cl.
*B21B 37/52* (2006.01)
*B21B 1/18* (2006.01)

(56) References Cited

U.S. PATENT DOCUMENTS

| | | | | | |
|---|---|---|---|---|---|
| 4,365,496 | A * | 12/1982 | Shiozaki | B21B 37/46 | 72/10.3 |
| 4,478,064 | A * | 10/1984 | Brenneman | B21B 1/222 | 72/232 |
| 7,870,775 | B2 * | 1/2011 | Hofer | B21B 35/04 | 72/249 |
| 2011/0041580 | A1 * | 2/2011 | Ogawa | B21B 37/46 | 72/31.07 |

* cited by examiner

Tecnica Anteriore

ROLLING STATION AND ROLLING MILL PLANT

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a rolling stand and/or rolling station according to the characteristics of the pre-characterizing part of claim 1.

The present invention also relates to a rolling mill plant.

The present invention also relates to a rolling process.

2. Description of Related Art Including Information Disclosed Under 37 CFR 1.97 and 37 CFR 1.98.

Definitions

In this description and in the appended claims the following terms must be interpreted according to the definitions given in the following. In the present description the term "bar" indicates a general product of a metal material worked in the form of a product whose lengthwise development has much greater sizes than the sizes of the section of the product itself measured on a section taken on a plane orthogonal with respect to the line defining its lengthwise development. Although in the terminology generally used in the specific sector of rolling one makes a distinction between "bar", "wire", "wire rod" according to the diameter, or, in general, to the sizes in section of the product of metal material, in the present description the term "bar" is understood as also comprising the products usually identified by the terms "wire" and "wire rod", that is to say, in general for the aim of the present description, comprising all the metal products obtained through a rolling process which may be rolled into bobbins or coils, or cut with an established length, packaged, and made available for the final use or for following working processes.

The expression "profile" of a bar indicates the shape of the bar along one of its orthogonal sections at its lengthwise development. Although in the description explicit reference is made to bars of a circular profile, the expression "profile" also means shapes other than circular, such as oval, elliptic, quadrangular, square, hexagonal shape, flat, band or sheet, "L"-shape, "C"-shape, "H"-shape, etc. It will be evident, in the light of the following description, that the present invention is applicable to a profile corresponding to a generic section, with minimum corrections that will be clear to a person skilled in the art. The term "bar" should be understood as also comprising different shapes in section as in the mentioned examples or other shapes suitable to be obtained by rolling.

In general one will use the expression "oblong metal material" to indicate said bars of any size in section, of any profile.

By the expression "rolling" one aims at indicating both hot rolling processes and cold rolling processes and by "rolled product" or "oblong metal material" one means a product resulting from rolling, both hot rolling and cold rolling.

The expressions roll/s and/or cylinder/s must be understood as substantially equivalent, as they are rotating elements of a cylindrical shape suitable for the mechanical working of the rolled product, which mechanically work the rolled product. The rolled product is made advance through a pair of rotating cylinders or rollers to undergo the mechanical deformation suitable to progressively reduce the thickness of the rolled product by means of a following passage in one or more rolling stations. Although in the embodiment illustrated the rollers or cylinders are represented as having a flat perimeter surface, by the expression rollers or cylinders one means to include also rollers or cylinders in which a first cylinder is provided with at least one first semi-channel and a second cylinder is provided with at least one second semi-channel, the reciprocal placing side-by-side of the cylinders involving the reciprocal placing side-by-side of the at least one first semi-channel and the at least one second semi-channel whose ensemble constitutes at least one rolling channel intended for the passage of the rolled product to be worked between said cylinders.

Prior Art

The oblong metal material in the form of bars is obtained, in general, from a production line that by means of rolling or extrusion processes brings about thermo-mechanical deformations on the metal material itself for the purpose of obtaining a bar with a determined profile and with determined sizes in section.

The production line, in general, comprises an initial portion of intermediate forging in which the oblong metal material of large sizes, usually indicated with billets, undergoes some initial treatments of thermo-mechanical deformation to turn it from a quadrangular section shape into an essentially round section shape. Afterwards, the production line includes an intermediate portion in which the oblong metal material generally, but not necessarily, undergoes successive thermo-mechanical deformations that turn it in sequence from essentially round section shapes into essentially ovoid section shapes with a progressive reduction in the size in section and extension of the oblong metal material. Finally, the production line includes one or more finishing portions intended to provide the oblong metal material with the final shape and sizes in section, if necessary with further working processes intended to obtain ribs or markings, division of the oblong metal material into two portions by means of "split lines", etc. Each portion of the production line includes one or more working stations and in each of the working stations a working phase of the oblong metal material occurs, that is to say, a thermo-mechanical transformation. For example in a first working station of the intermediate portion of the production line there may be a deformation of the oblong metal material from an essentially round section shape to an essentially ovoid section shape with a reduction in the sizes in section, while in a second working station downstream of the first working station according to the direction of advancement of the material on the line there may be a deformation of the oblong metal material from an essentially ovoid section shape to an essentially round section shape with a reduction in the sizes in section. The process continues in the sequence of working stations until obtaining an oblong metal product with a determined size or surface area in section and a determined profile, which can be, for example, circular, ovoid or elliptic, quadrangular, hexagonal, "L"-shaped, "C"-shaped, etc.

The working stations generally include rolling stands with a vertical axis and with a horizontal axis. The rolling stands with a vertical axis include a pair of working cylinders whose rotation axis is on a vertical axis. The rolling stands with a horizontal axis include a pair of working cylinders whose rotation axis is on a horizontal axis. In general the oblong metal material is thermo-mechanically worked within a working groove obtained by approaching the two working cylinders, wherein a first semi-portion of the working groove is obtained on a first cylinder and a second semi-portion of the working groove is obtained on a second cylinder. For example in the case of a rolling stand that produces an oblong metal material with a round section, on the first cylinder a first groove portion of an essentially semicircular shape is obtained and on the second cylinder a second groove portion of an essentially semicircular shape is obtained symmetrical with respect to the first groove portion present on the first cylinder. Although in the present description and in the attached figures reference is mainly made to a configuration relating to a horizontal rolling stand, the present invention is also applicable to the case of rolling stands with a vertical axis, with minimum and obvious adaptations that will be immediately clear to those skilled in the art.

In the rolling lines of more recent technology, the rolling stands are made up of a fixed part that constitutes the working station and a removable and interchangeable part, called cartridge, which includes a supporting structure of the cylinders that are pivotally supported by means of support and rotation bearings, the cartridge further including mechanical control means for the change in the reciprocal distance or distance between centres between the two cylinders, that is to say, for the change in the opening or gap of the rolling channel. The same cartridge can be provided both as a cartridge for equipping rolling stands with a horizontal axis and as a cartridge for equipping rolling stands with a vertical axis, by means of the ninety-degree rotation of the body of the cartridge. The structure of the working lines without cartridges is similar except for the presence of a supporting removable and interchangeable part of the working cylinders. The present invention, although referred to the solution of rolling mill plants with removable and interchangeable cartridges, is applicable to both solutions.

In prior art the rolling cartridges (9) are operated by means of a control system (FIG. 16) made up of one single AC electric motor (25) at variable speed, operated by means of inverters, which usually has a maximum speed of 2000 rpm, a connecting toothed joint (26) between the motor and reducer, a speed reducer with two output shafts (27) with parallel or orthogonal axes, with two output shafts which rotate mechanically synchronized, two adapters (28) generally of the universal joint type connected to the rolling cylinders (31), an adapters supporting device (29), a rolling cartridge (9) provided with a pair of rolling cylinders (31) that are connected to the rolling cartridge through the linings, two adjusting reducers of the cylinders (30). The coupling between each cylinder (31) and the corresponding adapter (28) occurs by means of a hub or flange.

During the rolling of the oblong metal material, the rolling channel present on the rolling cylinders (31) wears out more or less rapidly according to the type of rolled material and to other process parameters. Following the wear, the rolling channel progressively widens giving rise to an increase in the size in section of the oblong metal material. In order to compensate for the wear of the channel it is necessary to use universal joints to compensate for the change in the section of the oblong metal material. When a rolling channel is so worn-out that its wear can no longer be compensated for, one can generally resort to another rolling channel obtained on the same rolling cylinder, next to that subject to wearing. This operation occurs by shifting the rolling cartridge in such a way as to bring the new rolling channel in correspondence of the rolling line of the rolling mill plant, which is fixed. In the case of the horizontal rolling stands this occurs by translating the rolling cartridge horizontally, while in the case of the vertical rolling stands this occurs by translating the rolling cartridge vertically. The cylinders (31) must be replaced periodically and, to facilitate and fasten the change operation, the whole stand can be disengaged being moved back, creating the conditions in which the whole group of rollers is extractable. In the case of the removable cartridges, on the other hand, they can be rapidly replaced as they are mobile on a system of rails, in such a way as to position in their place a cartridge already prearranged with the new cylinders. The connection between the neck of the cylinder and the hub of the universal joint is made by means of a shape coupling that is loose in such a way as to allow for the quick fitting of the cylinder on the hub. The hubs in this phase are supported by a mechanical device during the phase of change of the cylinders. As observed, the rolling cylinders can have several channels and, in order to be able to bring the desired rolling channel in correspondence of the rolling line of the plant, which is fixed, the flange holding carriage, too, must be mobile, horizontally in the case of the horizontal stands and vertically in the case of the vertical stands. The above applies to channels, but this reasoning must be extended also to other shapes and to the use of other rolls of different shapes including cylindrical shapes without rolling channels.

WO 98/32549 describes a rolling system, of the type comprising at least one pair of opposite rolling cylinders or rollers or rolls in which each rolling cylinder or roller is controlled directly by a respective motor, the rolling system comprising control means intended to modify, to coordinate the speeds of the motors operating on the rolling cylinders or rollers so that each pair of cylinders or rollers has the same rotation speed.

EP 1 247 592 describes a rolling mill that has a pair of upper and lower rollers intended to roll a metal band, and motors for driving the upper and lower rollers respectively. Between the upper roller and the upper driving motor and between the lower roller and the lower driving motor there are provided connection means with a diameter greater than the diameter of the cylinders. The upper driving motors are placed on opposite sides of the coupled cylinders.

In the solutions disclosed in WO 98/32549 and EP 1 247 592, the rolling cylinders and the motors are reciprocally connected by means of long adapters connecting the rolling station to the motors which are mounted on the ground at a long distance from the rolling station itself, the connection between the rolling cylinders and the motors occurring without the use of a gear reducer.

EP 2 221 121 describes a rolling mill for products in the form of plates or sheets that eliminates the rolling problems due to the deformation of the rolled material and to the flatness faults shaped with waves that develop in the width direction on the plate or sheet. The system provides the supply of a pair of upper and lower working cylinders, a pair of electric motors intended to control independently the pair of cylinders, control means for controlling an electric motor using the rotation speed of a cylinder as an objective control value and to control the other electric motor using the rolling torque applied to the rolled material by the working cylinder operated by said electric motor.

JPS5982103 describes a system for the rolling of products in the form of a relatively thick plate in a double-motor rolling mill, controlling the cylinder on the low speed side by means of the ratio of different speeds of cylinders on the sides at high and low speed. A motor for driving a cylinder on the high speed side always applies a rolling torque to a cylinder on the high speed side. A driving motor of a cylinder on the low speed side applies a rolling torque to a cylinder on the low-speed side when the ratio of different speeds of the cylinders of the high and low speed sides is lower than a required value and when said ratio is higher than the required value.

Problems of the Prior Art

The prior art solutions are particularly bulky to the extent that the rolling stands need considerable foundation works also considering the overall weight of the supporting structures of the rolling stands in which the rolling cartridges are inserted. As a consequence, also a plant with a reduced number of rolling passages needs a large space for its realization.

Furthermore, each rolling stand houses one single motor that, through a system of joints and reducers, controls both rolling cylinders installed on the cartridge, the motor having to be necessarily a motor of large sizes to be able to control both rolling cylinders and bear the rolling effort induced by the rolled product.

The mechanical transmission that is used to control the two rolling cylinders is complex and heavy.

Aim of the Invention

The aim of the present invention is to provide a rolling station with simplified mechanical transmission between the driving means of the rotation of the rolling cylinders and the rolling rollers or cylinders themselves.

BRIEF SUMMARY OF THE INVENTION

The aim is achieved by the characteristics of the main claim. The sub-claims represent advantageous solutions.

Advantageous Effects of the Invention

The solution according to the present invention, by the considerable creative contribution the effect of which constitutes an immediate and important technical progress, presents various advantages.

The solution according to the present invention allows to reduce the number of components necessary to the transfer of the driving torque from the driving means of the rotation of the cylinders and said cylinders also allowing for a compacting of the structure.

Furthermore, the solution according to the present invention also allows to obtain a reduction in the weight of the machines and of the used structures, with advantages both from the point of view of the cost of the machines, and from the point of view of their transport, for example during the construction of a rolling mill plant. Moreover, the number of the moving parts is also considerably reduced.

Furthermore, the solution according to the present invention also allows to reduce the costs of the foundations and to create a much more compact layout of the rolling mill plant, allowing for the realization of rolling mill plants with the same or better performances with respect to those of the prior art but with smaller overall dimensions and required space on the ground.

Furthermore, the present invention also allows to obtain rolling stations with greater performances and greater possibilities of control of the rolling process.

Furthermore, the solution according to the present invention advantageously allows for the application to existing plants as well, for example in an update phase of the latter or part of the latter, in which case it is possible for example to maintain the existing rolling cartridges, reducing the space required by the rolling stands into which the existing cartridges are inserted, being able to use this space for other equipment.

Finally, the present solution allows to obtain greater functionality, lower power consumption due to reduced friction and greater operating efficiency.

BRIEF DESCRIPTION OF THE DRAWINGS

In the following a solution is described with reference to the enclosed drawings to be considered as a non-exhaustive example of the present invention in which.

DETAILED DESCRIPTION OF THE INVENTION

Figure 1:
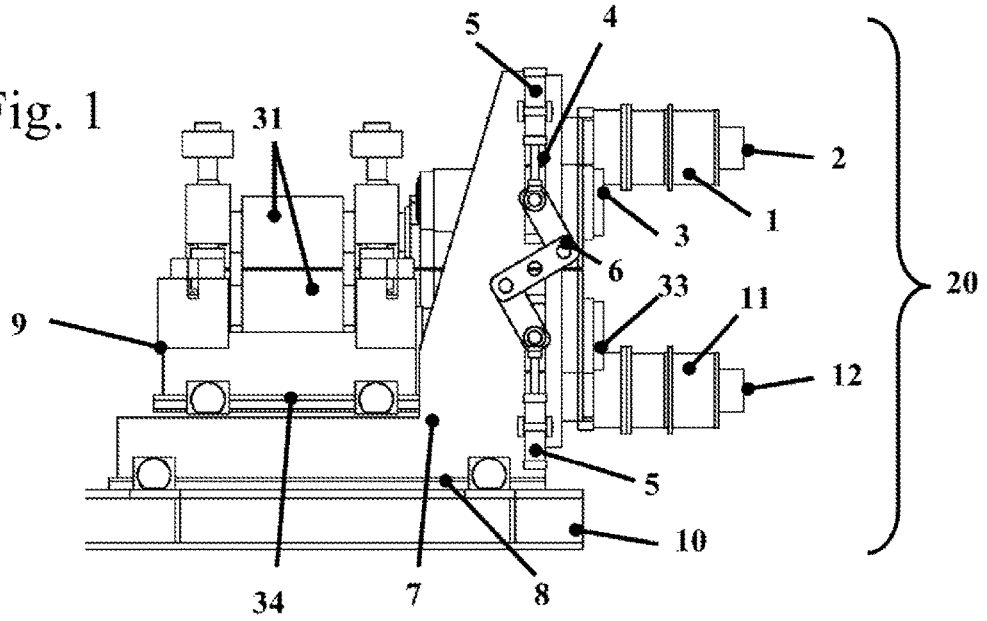
FIG. 1 schematically shows a front view of a rolling station made according to the present invention relating to a rolling stand with a horizontal axis.
Figure 2:
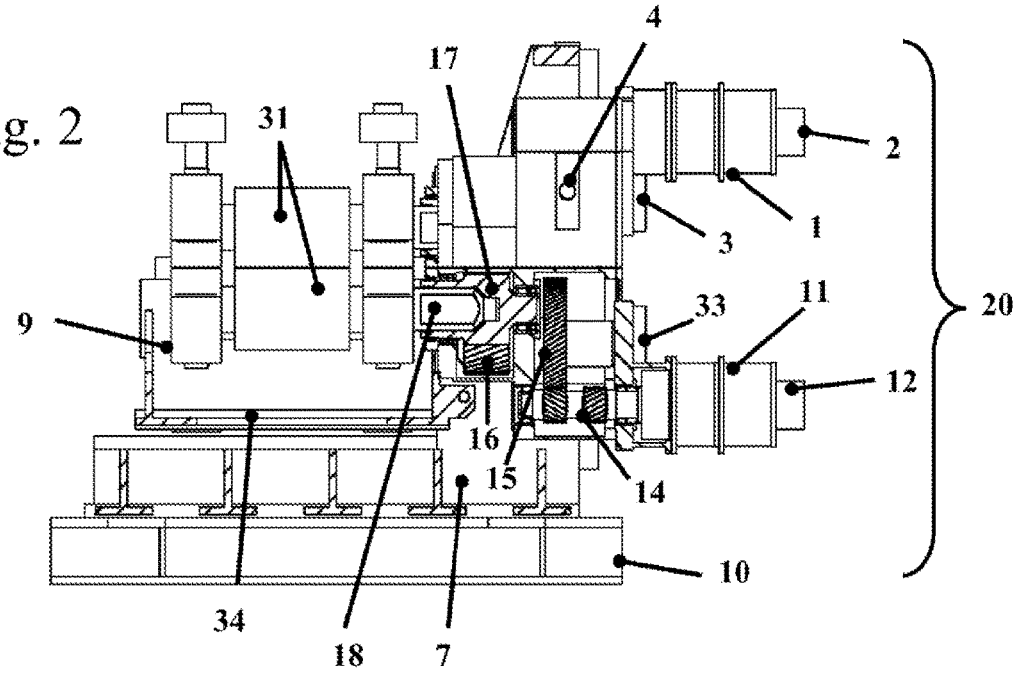
FIG. 2 schematically shows the rolling station of FIG. 1 in which the rolling station has been partially represented in section to let catch sight of the internal transmission device.
Figure 3:
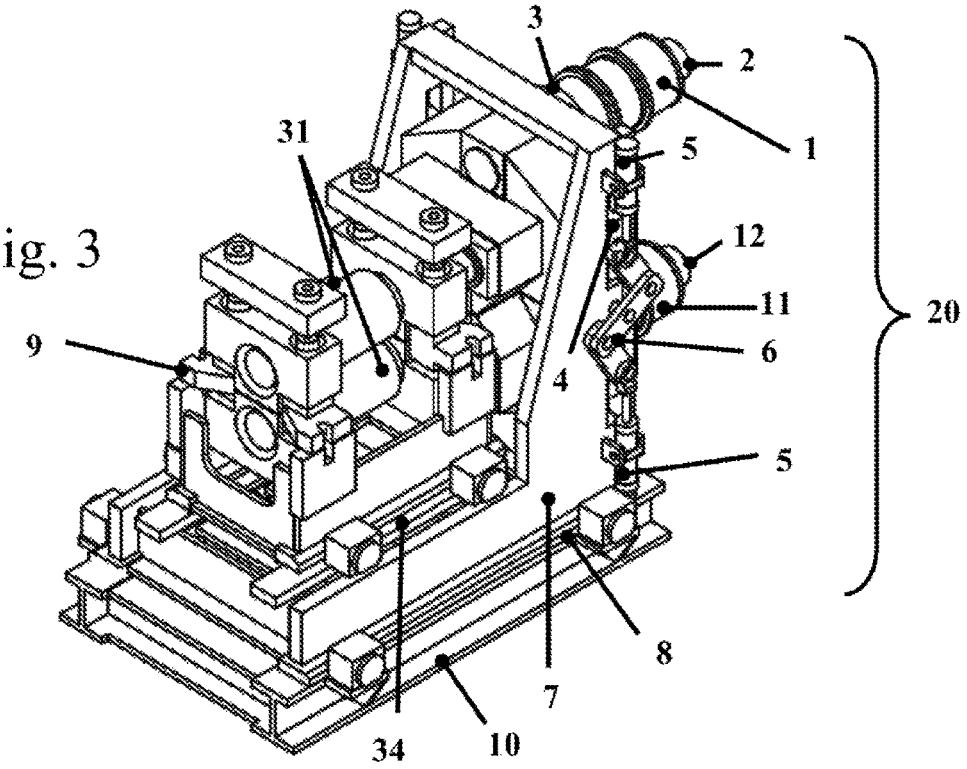
FIG. 3 schematically shows a front three-quarter view of the rolling station of FIG. 1.
Figure 4:
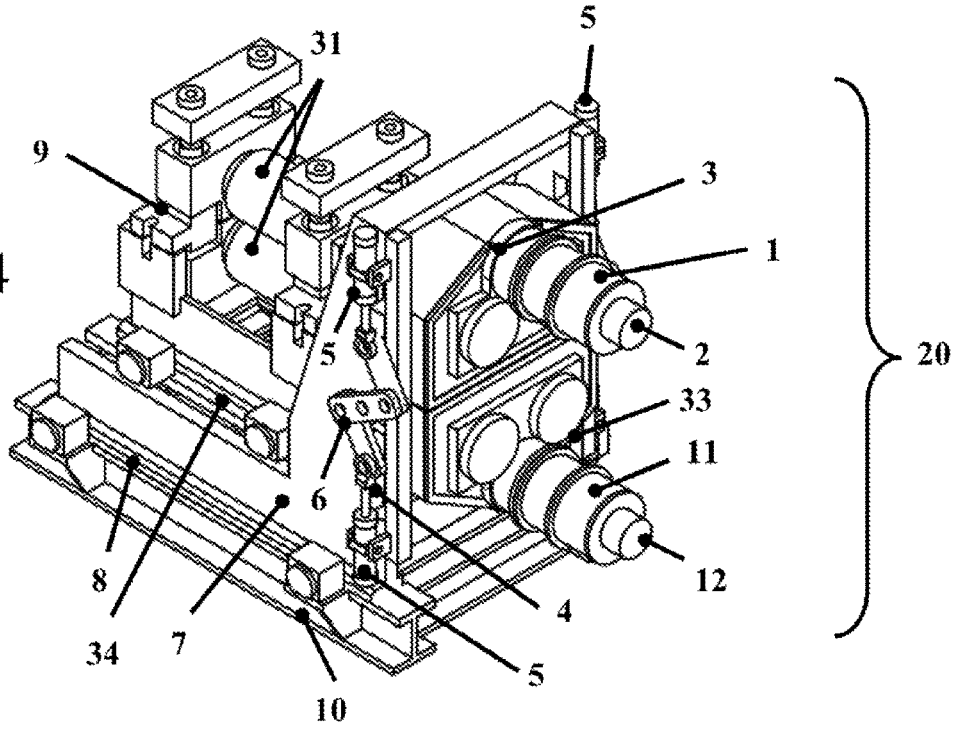
FIG. 4 schematically shows a back three-quarter view of the rolling station of FIG. 1.
Figure 5:
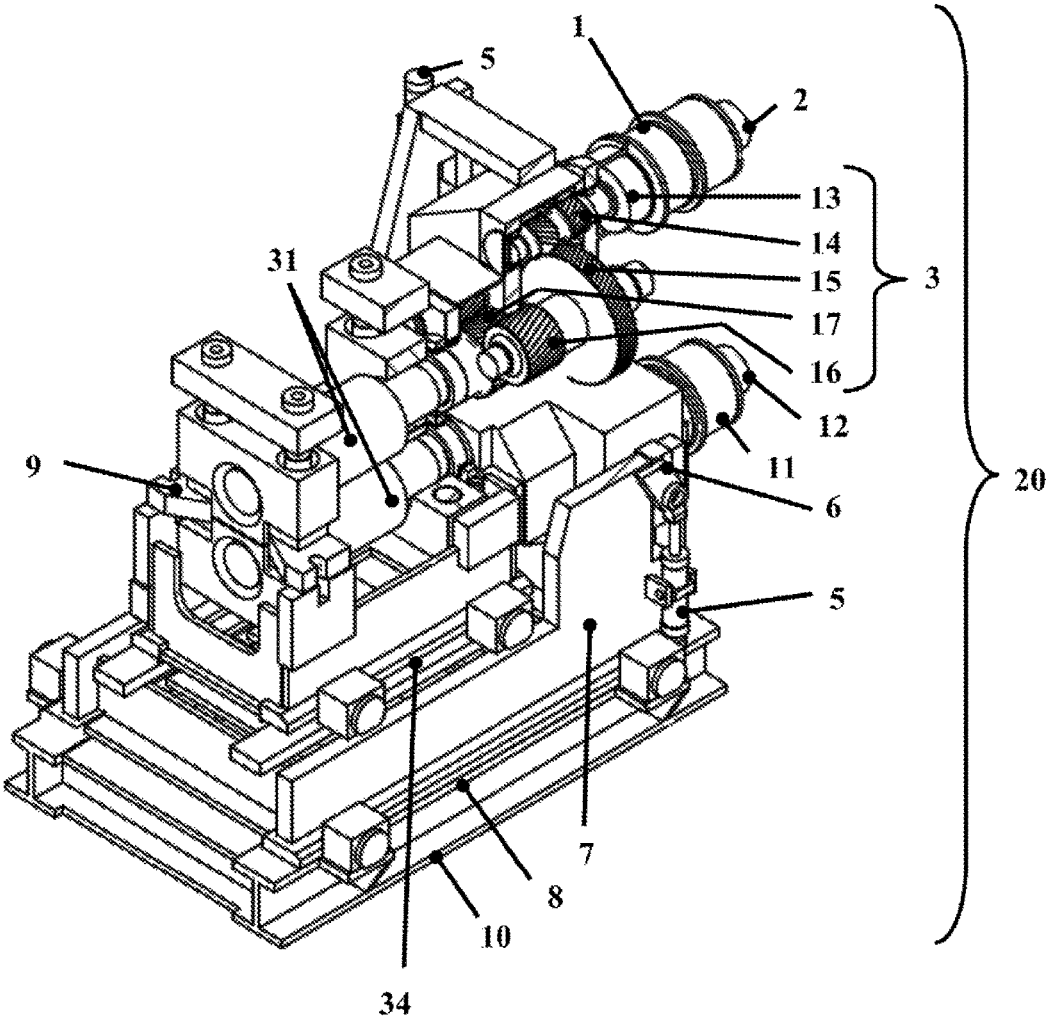
FIG. 5 schematically shows the rolling station of FIG. 3 in which the rolling station has been partially represented in section to let catch sight of the internal transmission device.
Figure 6:
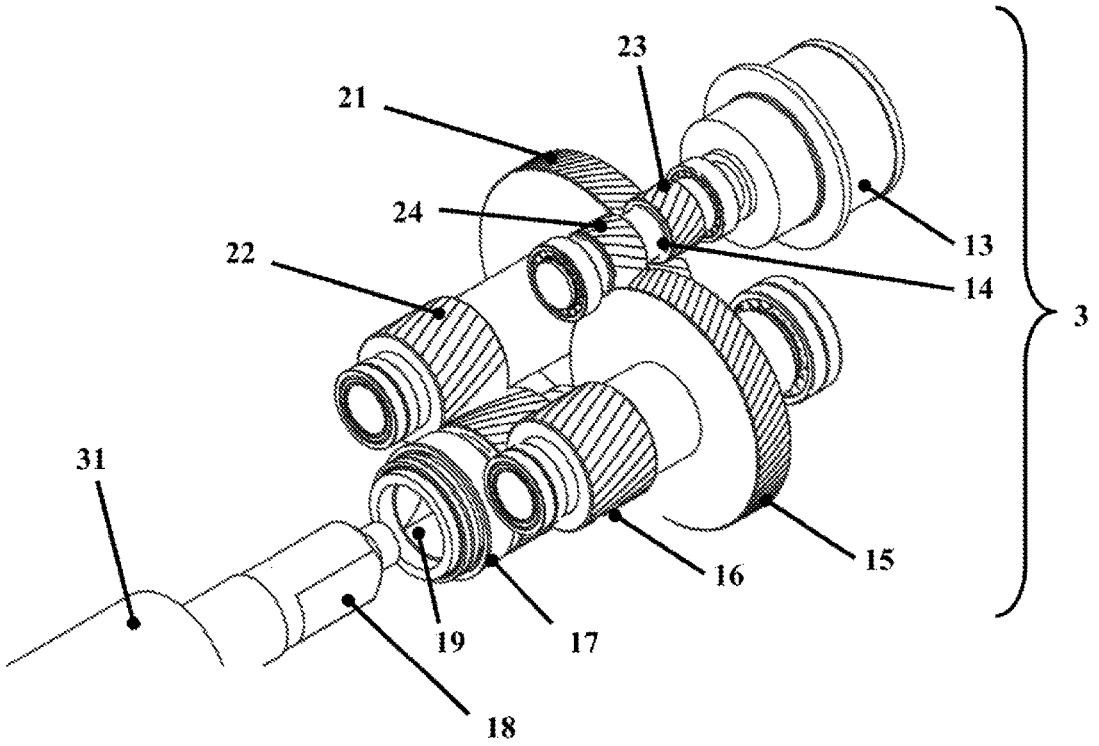
FIG. 6 schematically shows a perspective view of the transmission device relating to one of the cylinders of the rolling stand.
Figure 7:
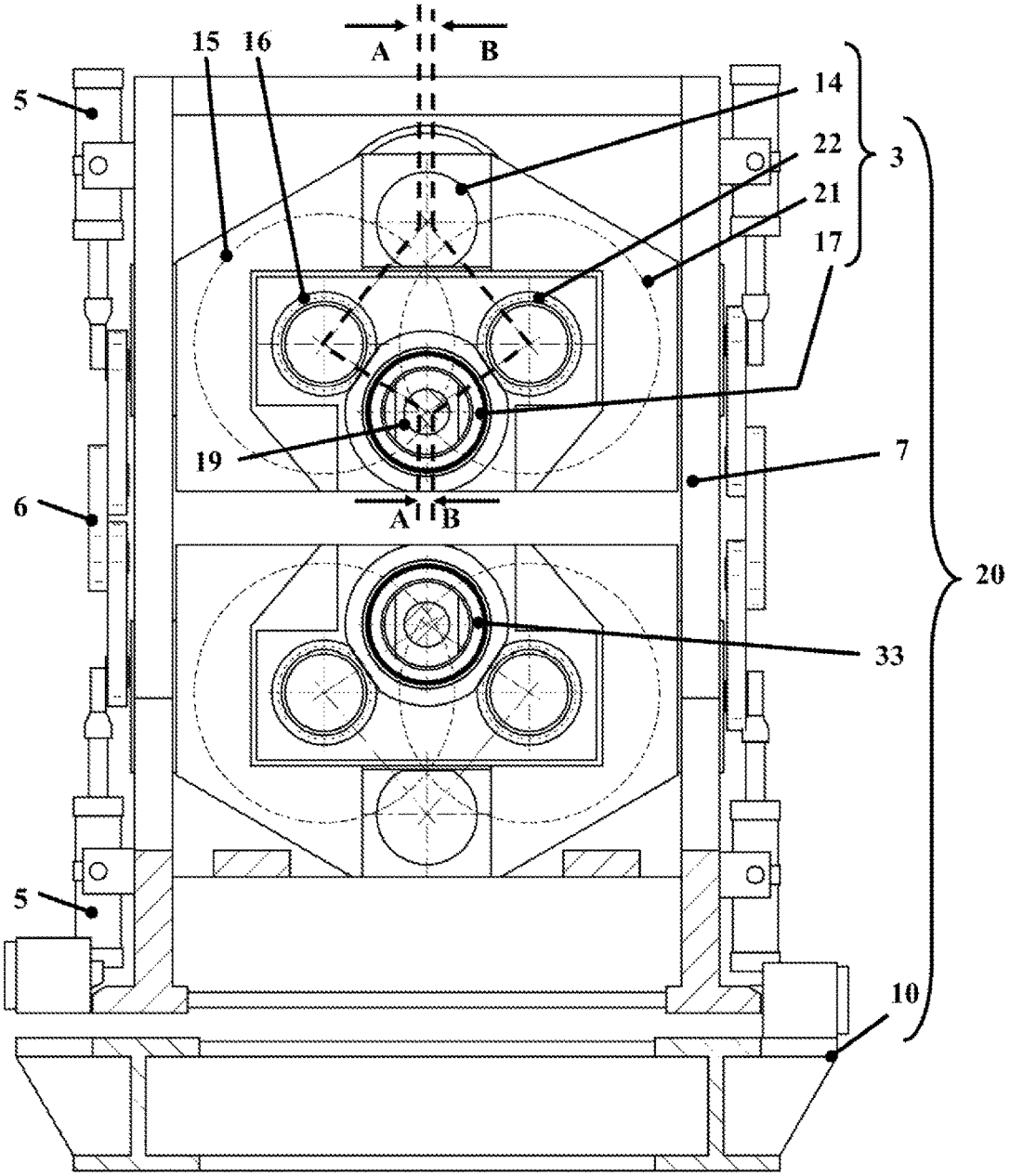
FIG. 7 schematically shows a side view of the rolling station made according to the present invention relating to a rolling stand with a horizontal axis.
Figure 8:
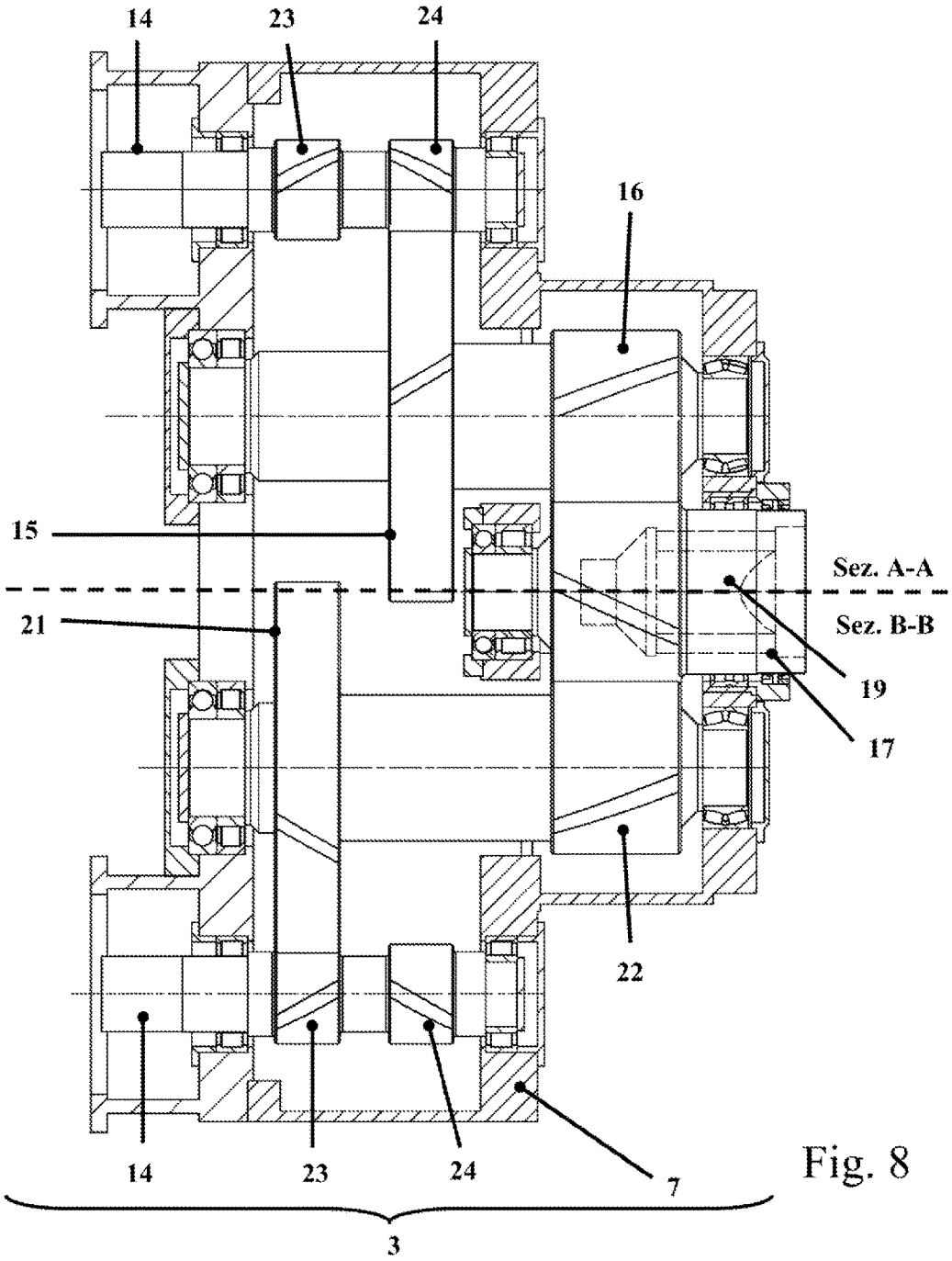
FIG. 8 schematically shows a sectional view of the rolling station of FIG. 7 in which the sectional views indicated with A-A and B-B have been placed next to each other.

With reference to the figures (FIG. 1, FIG. 2, FIG. 3, FIG. 4, FIG. 5) the present invention relates to the control system of a rolling stand. In the solution according to the present invention the rolling cartridge (9) remains advantageously the same, with the additional advantage that the present solution can be implemented independently of the type of rolling cartridge adopted on the plant and with the advantage that the application of the present invention is advantageous in the case of existing plants as well.

The oblong metal product is worked to obtain a determined size or surface area in section and a determined profile, which can be, for instance, circular, ovoid or elliptic, quadrangular, hexagonal, "L"-shaped, "C"-shaped, etc.

According to the invention, each of the cylinders (31) is controlled by a respective high-speed electric motor, indicatively but not exclusively between 3000 and 5000 RPM. The first motor (1) and the second motor (11) are preferably of the AC type. The cylinders (31) consist of a first rolling cylinder and a second rolling cylinder rotating opposite to each other, that is to say, according to opposite rotational directions. Each motor is provided with a respective control inverter that allows for the independent control of the first motor (1) with respect to the second motor (11) and vice versa. A first rolling cylinder is controlled by a first electric motor (1) and a second rolling cylinder is controlled by a second electric motor (11). Each of the first electric motor (1) and second electric motor (11) is coupled with the respective rolling cylinder (31) by means of a transmission device, that is to say, a first transmission device (3) for the first motor (1) and a second transmission device (33) for the second motor (11). The transmission device (3, 33) is provided (FIG. 2, FIG. 5, FIG. 6, FIG. 7, FIG. 8) with a shaft or first output pinion (17) equipped with a transmission slot (19) for the engagement of the hub (18) of the respective cylinder of the two cylinders (31) of the stand or cartridge (9). The shaft or first output pinion (17) is controlled in rotation by means of the combined and coordinated action of a second torque division pinion (16) integral with a first crown (15) by which it is put in rotation and of a third torque division pinion (22) integral with a second crown (21) by which it is put in rotation, the first crown (15) and the second crown (21) being put in rotation by means of a fourth self-balanced pinion (14) provided with a first gear (23) of transmission of the rotational motion to the first crown (15) and further provided with a second gear (24) of transmission of the rotational motion to the second crown (21). The fourth self-balanced pinion (14) in its turn receives the rotational motion from the motor (1, 11) with the interposition of an epicyclic reduction gear (13).

The first output pinion (17) is controlled by a pair of pinions, that is to say, a second torque division pinion (16) and a third torque division pinion (22). As a consequence, with equal sizes of the overall gear (diameter, band, module) it is possible to transmit twice the torque with respect to the use of one pinion only. However, each of the two cylinders (31) must be controlled by one respective motor only, that is to say, the first motor (1) for a first of the two cylinders (31) and a second motor (11) for a second of the two cylinders (31). Therefore, for each of the two cylinders (31) a device is necessary, which divides the torque of the respective motor in an exactly equal way onto two different chains of gears to transmit it to the only first output pinion (17) of the respective cylinder. For this purpose a fourth self-balanced pinion (14) is used, which is provided with a double toothed band with opposite screws, that is to say, provided with a first helical gear (23) and with a second helical gear (24) wherein the screw constituting the first helical gear (23) is made according to one shape opposed to the screw constituting the second helical gear (24). Therefore the first gear (23) transmitting the rotational motion and the second gear (24) transmitting the rotational motion are respectively a first helical gear (23) shaped with a first screw and a second helical gear (24) shaped with a second screw, wherein the first screw constituting the first helical gear (23) is made according to one shape opposed to the second screw constituting the second helical gear (24). That is to say, the first screw has the respective teeth of the first helical gear (23) oriented according to an opposite orientation with respect to the orientation of the teeth of the second screw of the second helical gear (24). The division of the torque into an exactly equal value between the first helical gear (23) and the second helical gear (24) is guaranteed by the fact that the fourth self-balanced pinion (14) is not axially locked and, in order to keep in dynamic balance, the axial components of the meshing forces on the first helical gear (23) and on the second helical gear (24) must be exactly identical and contrary. Therefore, also the tangential meshing force on the first helical gear (23), to which the torque is directly linked, will be equal to the tangential meshing force on the second helical gear (24) and as a result the transmitted torques will be equal too.

Figure 17:
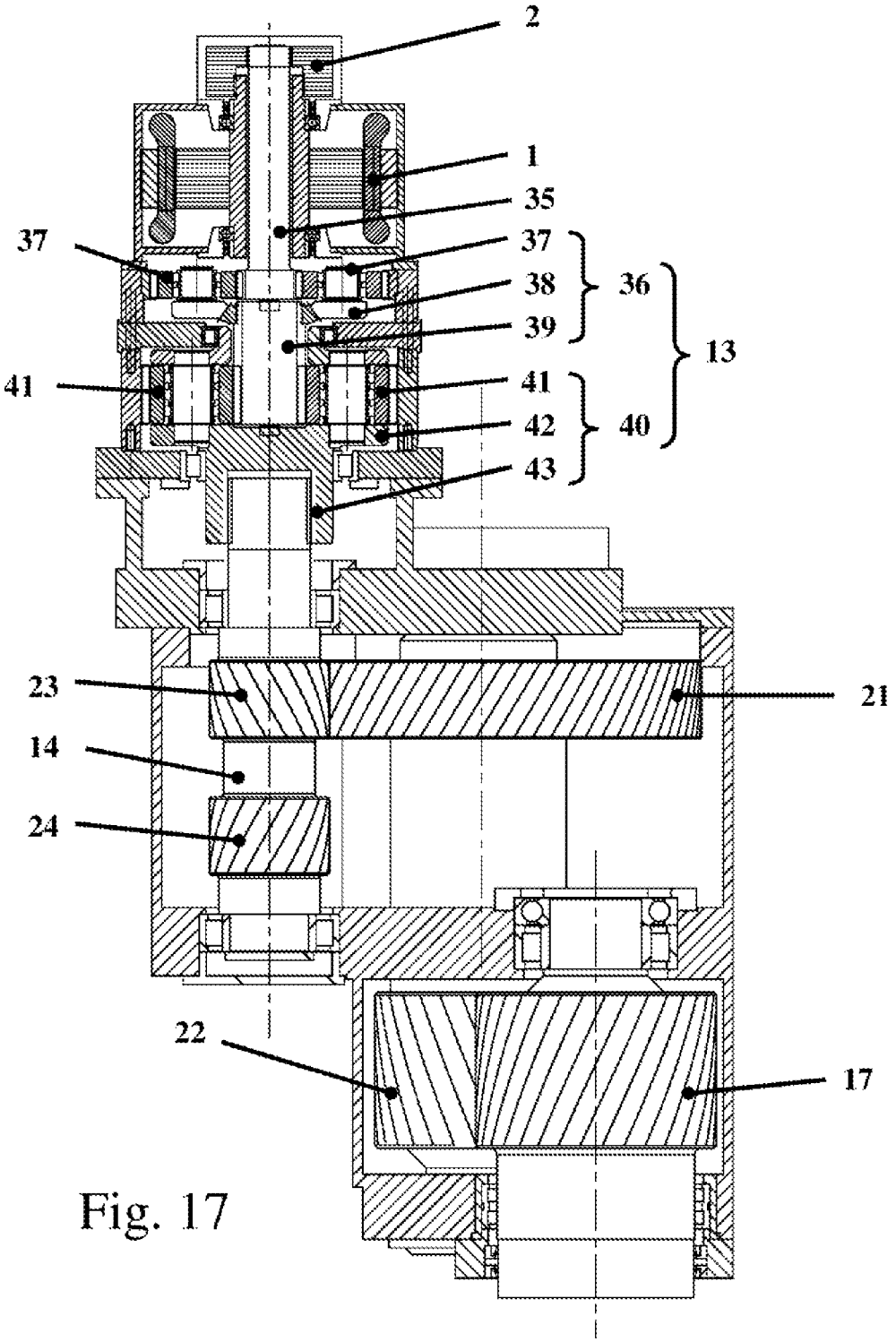
FIG. 17 schematically shows a sectional view of the initial portion of transmission from the motor to the transmission device of a rolling station made according to the present invention.

The epicyclic reduction gear (13) is preferably made up (FIG. 17) of a first stage (36) onto which a first input shaft (35) engages that can be directly the output shaft of the motor (1, 11) or a shaft of connection with the output shaft of the motor. The preferred solution is the one in which the first input shaft (35) is directly the output shaft of the motor (1, 11), because the weight and rotating masses of the transmission system are minimized to the advantage of greater reliability and lower costs. The first input shaft (35) acts on first planetary gears (37) of the first stage (36), which are rotationally supported by a first planetary-gears support (38) which in its turn puts in rotation a second shaft (39). The second shaft (39) transmits the rotational motion from the first stage (36) to a second stage (40). The second shaft (39) acts on second planetary gears (41) of the second stage (40), which are rotationally supported by a second planetary-gears support (42) which in its turn puts in rotation a third shaft (43). The third shaft (43) in its turn is coupled with the fourth self-balanced pinion (14) of the first transmission device (3) in the case of the first motor (1) or of the second transmission device (33) in the case of the second motor (11).

Figure 12:
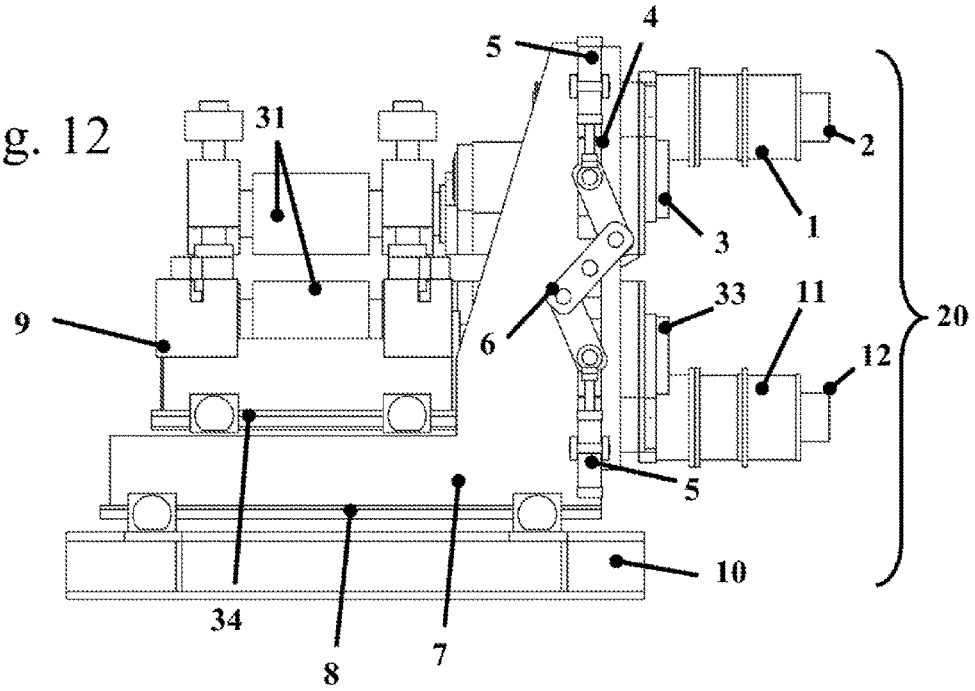
FIG. 12 schematically shows a front view of a rolling station made according to the present invention relating to a rolling stand with a horizontal axis, in a second adjustment configuration.
Figure 16:
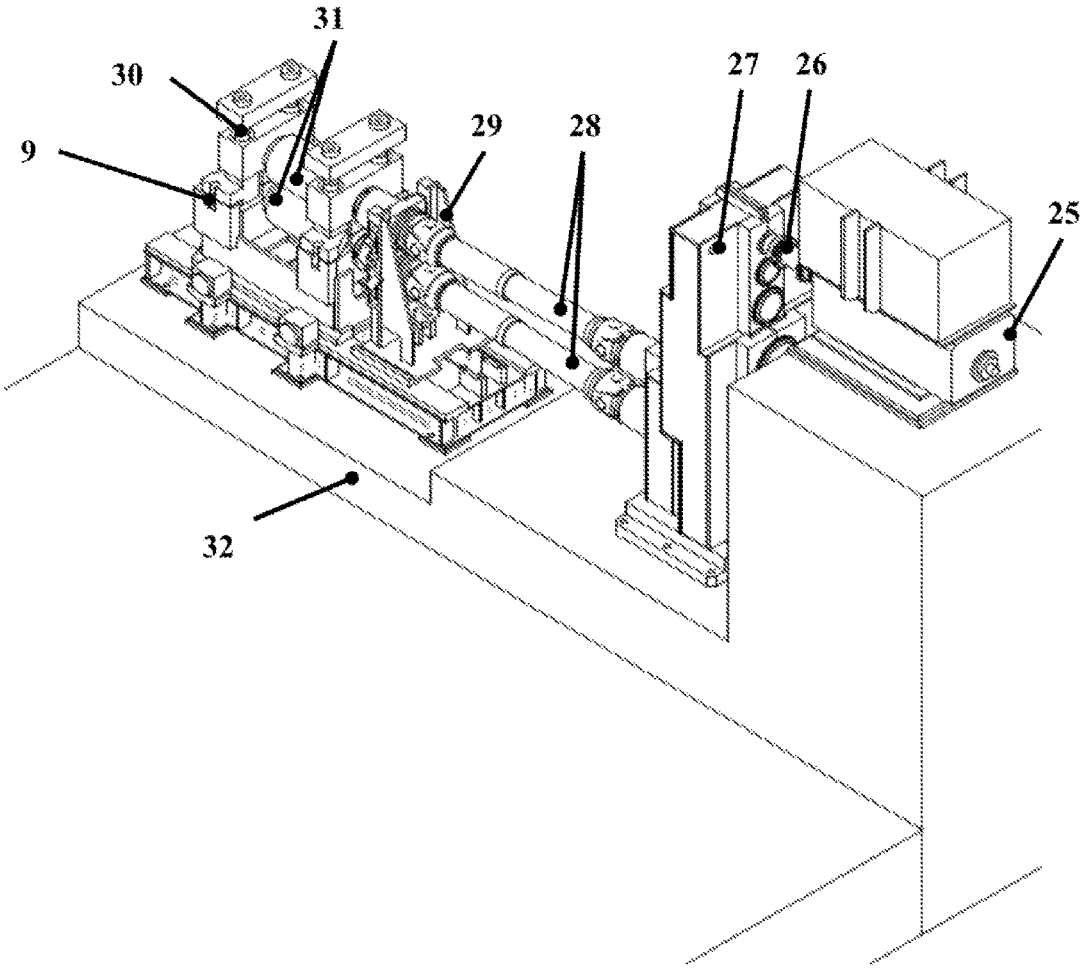
FIG. 16 schematically shows a perspective view of a rolling station of the prior art relating to a rolling stand with a horizontal axis.
Figure 18:
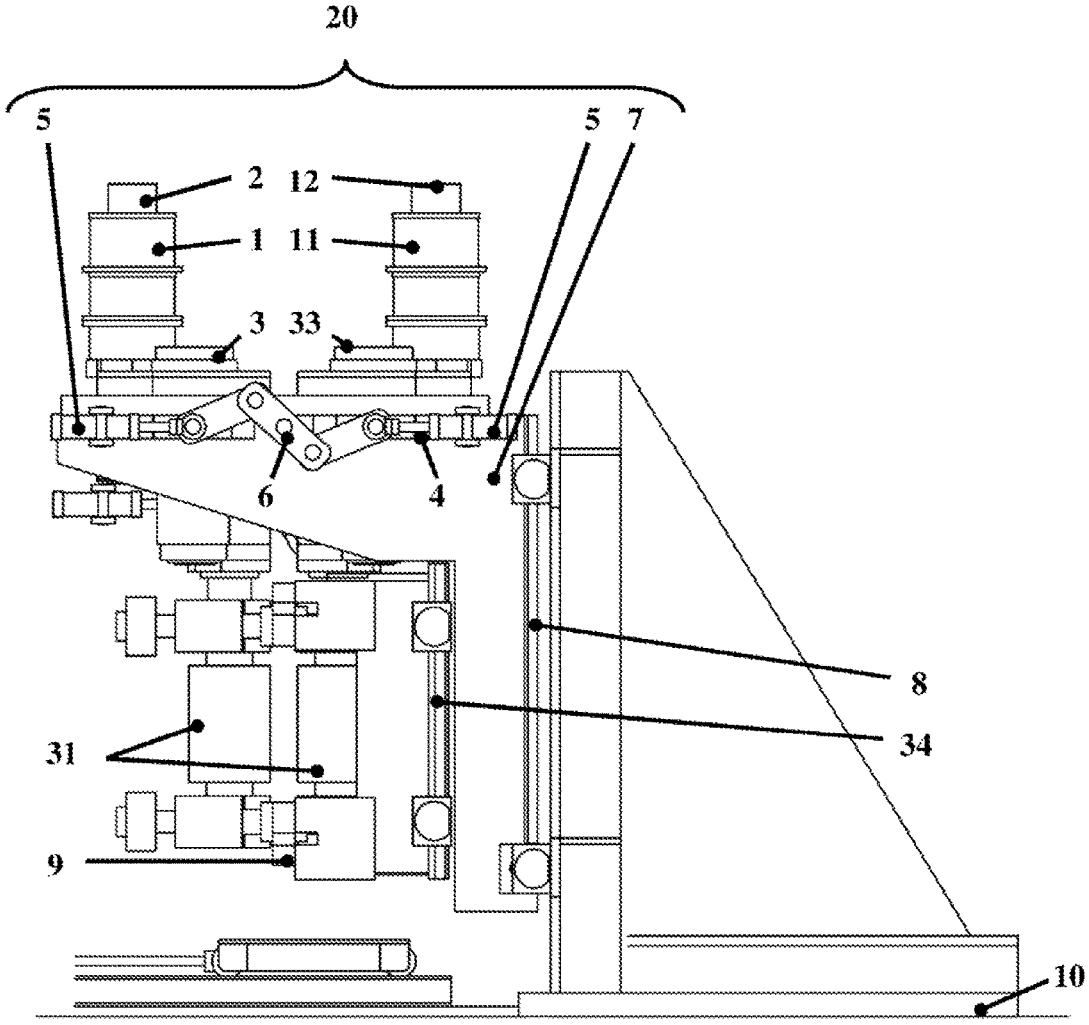
FIG. 18 schematically shows a front view of a rolling station made according to the present invention relating to a rolling stand with a vertical axis.

The present invention provides the use of two transmission devices (3, 33) with divided torque for the purpose of reducing their weight and sizes. The application of transmission devices (3, 33) with divided torque determines a weight reduction, with respect to the current solutions, by about 30-35% only of the part related to the transmission devices themselves, without considering the elimination (FIG. 16) of the adapters (28) of the prior art systems and the lower cost of the electric motors, that is to say, of the first electric motor (1) and of the second electric motor (11) with respect to the single motor (25) of the prior art solutions. Further benefits derive from the fact that, by adopting a more compact and lighter structure for the realization of the stand, thanks to the previously mentioned size and weight reductions, there is also a significant reduction in the construction needs of the plant and in particular as to the realization of the (FIG. 16) foundations (32) that may be reduced if not even eliminated. Furthermore, the plant as a whole will be considerably more compact, as is evident also from the comparison between the prior art solutions (FIG. 16) and the solution according to the present invention (FIG. 4) and considering that a rolling mill plant usually requires the presence of 14-16 rolling stands plus, if necessary, further finishing machines. The two transmission devices (3, 33), that is to say, the first transmission device (3) and the second transmission device (33), are supported by a supporting frame (7) of the transmissions. The two transmission devices (3, 33) are sliding on the supporting frame (7) of the transmissions by means of guides of the transmissions (4), which allow for their movement on the basis of the positioning of the rolling stand, for the purpose of adapting the position of the two transmission devices (3, 33) to the rolling line. For example in the case of a rolling station (20) suitable for housing a cartridge (9) according to a horizontal cylinders (31) configuration (FIG. 12), the two transmission devices (3, 33) will be vertically sliding. For example in the case of a rolling station (20) suitable for housing a cartridge (9) according to a vertical cylinders (31) configuration (FIG. 18), one or both transmission devices (3, 33) will be horizontally sliding. The sliding of the two transmission devices (3, 33) can be locked by means of respective locking means (5) of the transmission preferably of the hydraulic type. For example the described adjustment can be used for the adjustment of the reciprocal distance between the cylinders (31) depending on the wear conditions of the latter. As a consequence, in case of need for adjustment, the procedure provides that:

one unlocks the locking means (5) of the transmission;

one controls the adjustment of the position of the transmission devices (3, 33), during this phase the transmission devices (3, 33) being suspended with a supporting compensator (6) of the transmission that allows for a self-balance in such a way that the transmission devices (3, 33) may be moved by some drives that can be hydraulic or mechanical, but that must overcome only the friction of the guide mechanism (4) of the transmission;

one locks the locking means (5) of the transmission.

Figure 10:
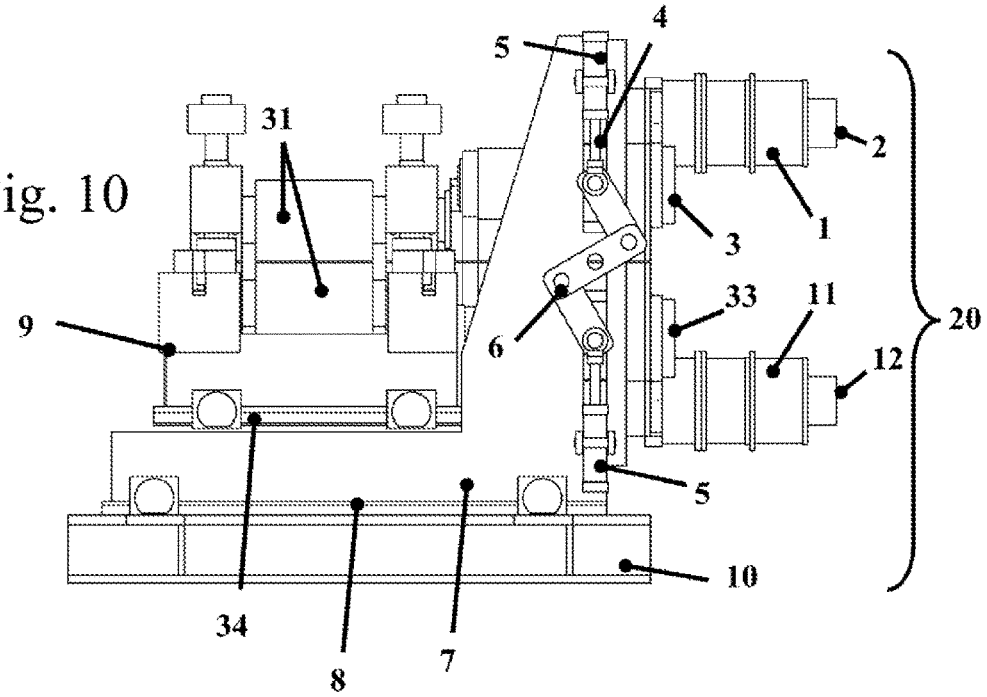
FIG. 10 schematically shows a front view of a rolling station made according to the present invention relating to a rolling stand with a horizontal axis, in a first adjustment configuration.
Figure 11:
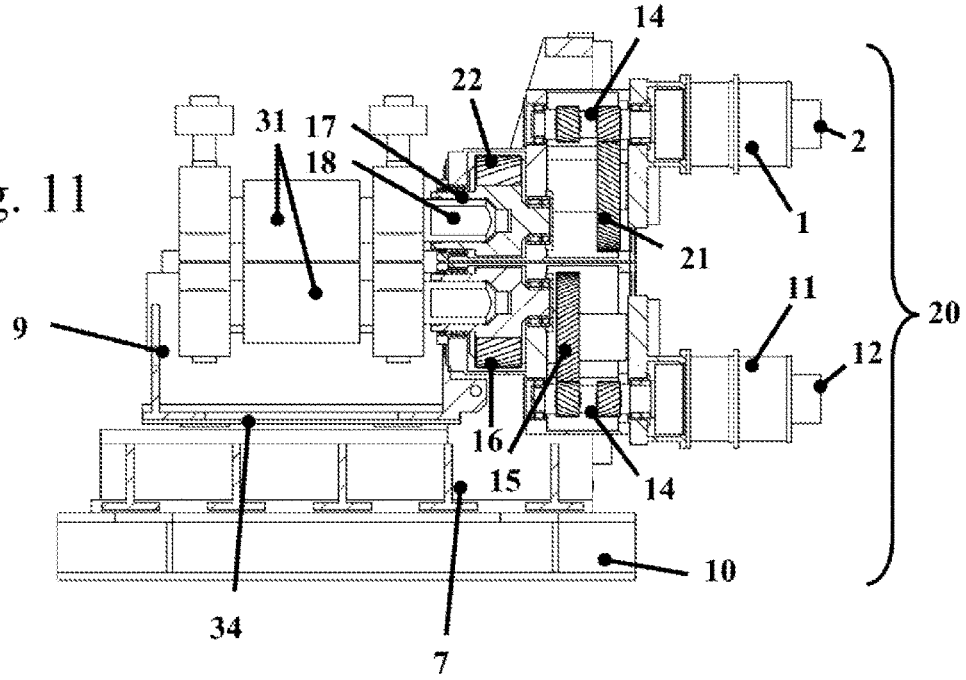
FIG. 11 schematically shows a sectional view of the rolling station of FIG. 10.
Figure 13:
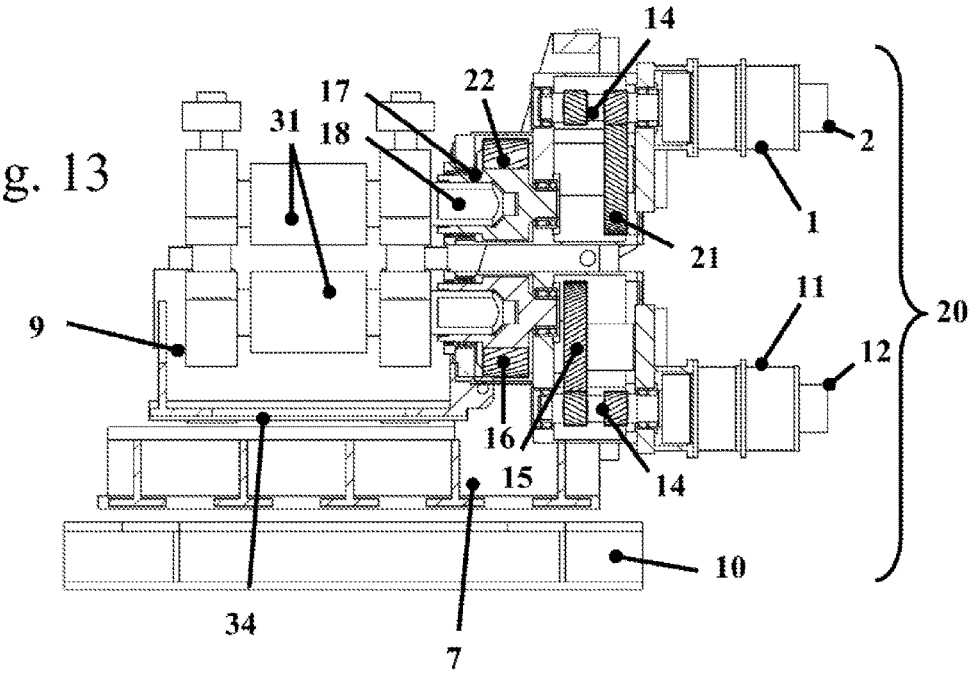
FIG. 13 schematically shows a sectional view of the rolling station of FIG. 12.

For example (FIG. 10, FIG. 11), from a reciprocally close position of the two cylinders (31), acting as previously described, one can reach (FIG. 12, FIG. 13) a reciprocally spaced position of the two cylinders (31). The supporting compensator (6) preferably consists of three levers, of which:

a central lever hinged on the supporting frame of the transmissions (7) in correspondence of a midpoint between a first end and a second end of said central lever;

a first transmission lever hinged in correspondence of the first end of the central lever and on which a first element of locking means of the reduction gear (5) acts;

a second transmission lever hinged in correspondence of the second end of the central lever and on which a second element of locking means of the reduction gear (5) acts.

In this way, therefore, one can control the adjustment of the position of the transmission devices (3, 33), with the transmission devices (3, 33) which are suspended by means of the supporting compensator (6) of the transmission. The adjustment of the position of the first transmission device (3) and of the second transmission device (33) is reciprocally coordinated by means of the supporting compensator (6), the first transmission device (3) and the second transmission device (33) being suspended from the supporting frame (7) of the transmissions by means of said supporting compensator (6) of the transmission.

Figure 9:
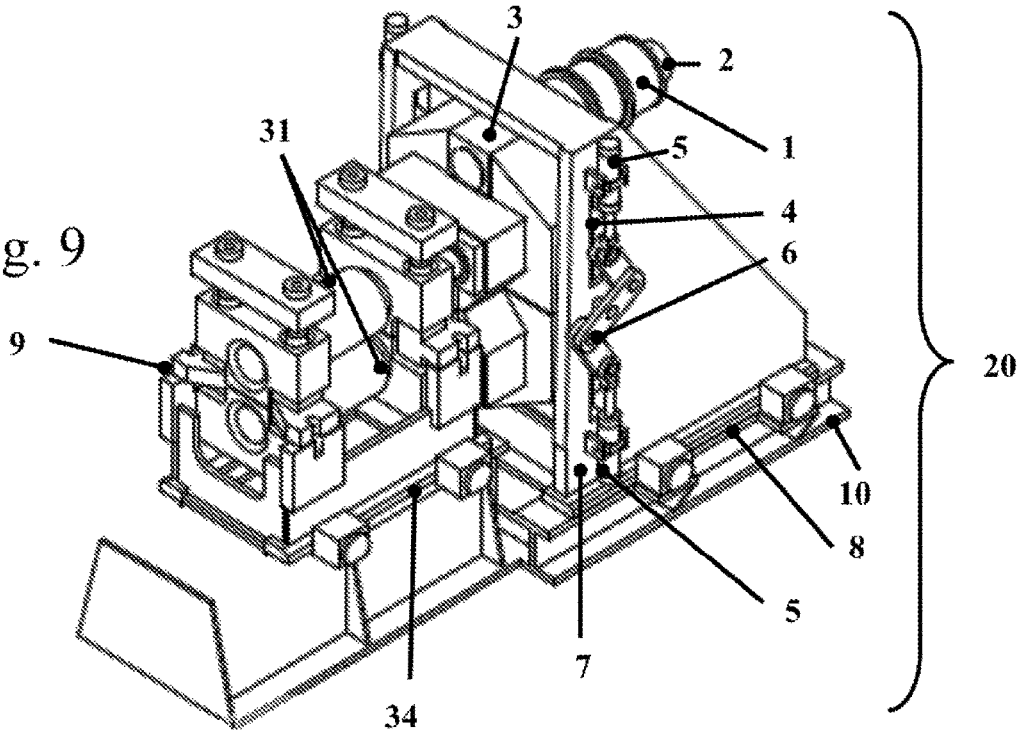
FIG. 9 schematically shows a front three-quarter view of a different embodiment of the rolling station according to the present invention.
Figure 14:
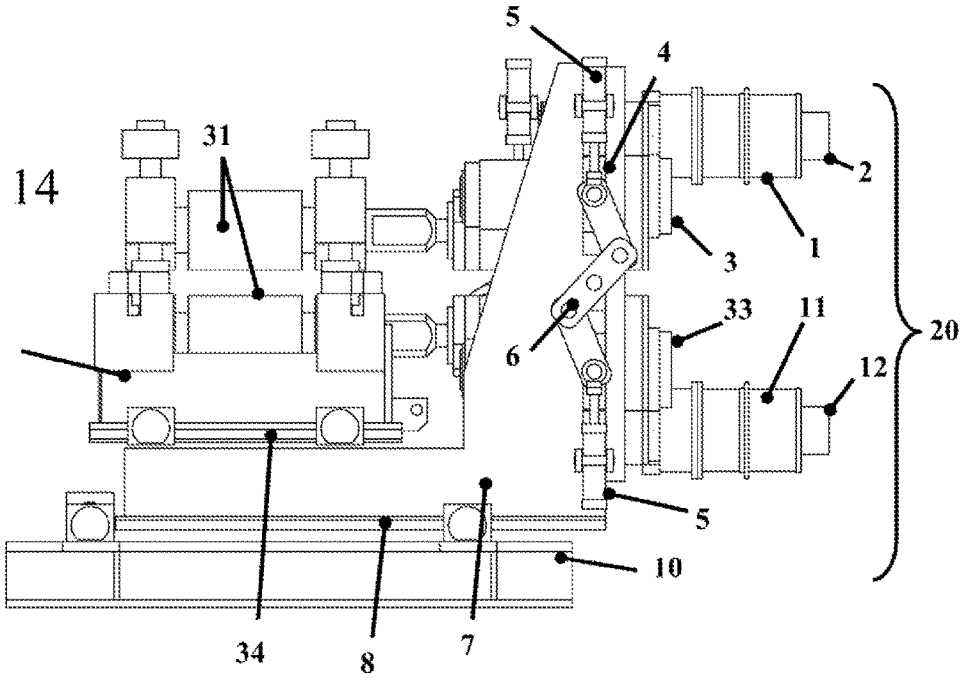
FIG. 14 schematically shows a front view of a rolling station made according to the present invention relating to a rolling stand with a horizontal axis, during the coupling with the corresponding rolling cartridge.
Figure 15:
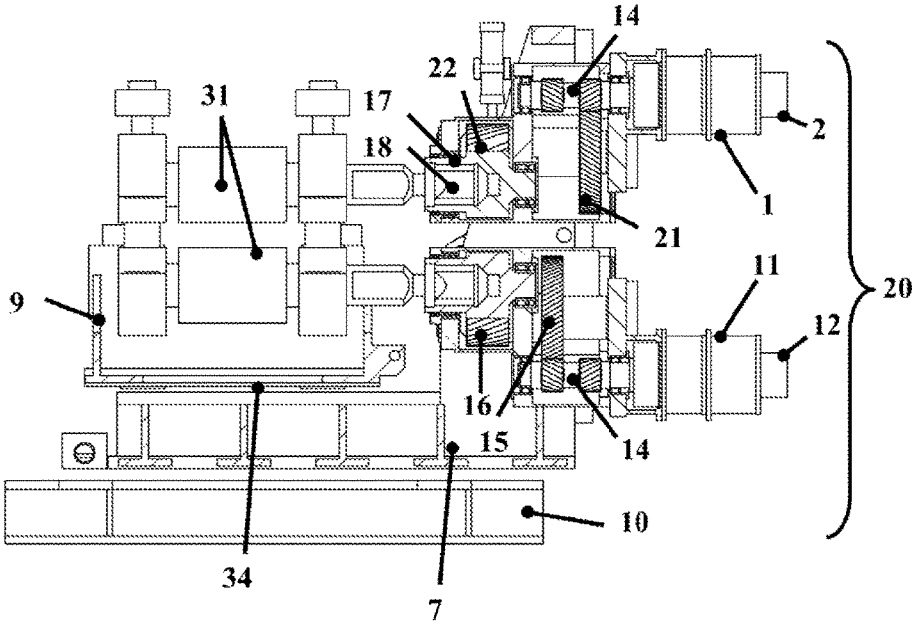
FIG. 15 schematically shows a sectional view of the rolling station of FIG. 14.

Furthermore, adjustments are provided to allow to carry out the channel change. In fact, each rolling cylinder can be provided with several rolling channels for the purpose of enabling a fast channel change for example in case of wear of the channel in use with a new channel or to change the channel in use with another channel having different characteristics. For example it may be provided that the supporting frame of the transmissions (7) is mobile with respect to the anchorage frame (10) for the adjustment of the position of the rolling channel obtained on the cylinders (31). Furthermore (FIG. 14, FIG. 15) the rolling cartridge (9) can be sliding on own guides of the cartridge (34) to enable its insertion (FIG. 12) or extraction (FIG. 14) with respect to the rolling station (20). As a consequence, the rolling station (20) is preferably provided with an anchorage frame (10) for its fixing to the floor. The anchorage frame (10) is provided with guides of the frame (8) suitable to allow for the movement of the supporting frame (7) of the transmissions. Furthermore, guides of the stand (34) may be present. The guides of the frame (8) and the guides of the stand (34), can be made in the superimposed configuration (FIG. 3) or in line (FIG. 9) or according to other configurations, according to the plant layout.

The two cylinders (31) are controlled in an independent way, and through the inverter and management system the necessary adjustments can be made to obtain a perfect synchronism of the system. This is observed to be a big advantage with respect to the present state of the art, which is bound by a single transmission of the two cylinders.

With the present invention it is not necessary to realize the foundation for the support of the reduction gear and of the motor, obtaining a considerable saving in the realization of the civil works. Moreover, the necessary space is considerably reduced and therefore the sizes of the shed can be reduced as well. Therefore, the saving achieved with the application of the present invention is not only linked to the transmission system, but in particular to the simplification that is introduced to the whole structure of the plant.

In particular the use of two motors, that is to say, a first electric motor (1) for a first rolling cylinder and a second electric motor (11) for a second rolling cylinder of the rolling stand allows to use motors of a smaller size with respect to the single motor used in the prior art solutions, with lower costs, better performances from the point of view of control. Furthermore, the possibility to control in an independent way the rotation of each of the two rolling cylinders allows to obtain benefits from the point of view of the quality of the material. In fact, in this way one obtains the possibility to modify the peripheral speeds of the rolling cylinders in a reciprocally independent way also during the rolling process, that is to say in loading conditions. For example one can change the rotation speed of one cylinder with respect to the other according to the load and to the effort detected on each rolling cylinder to compensate for possible differences which may be the symptom of the wear of one cylinder with respect to the other or of the unevenness of the material, such as unevenness in the section, unevenness in the temperature, unevenness in correspondence of the head and/or of the tail of the oblong metal material, etc. In this way such problems can be solved by varying the speed of a cylinder with respect to the speed of the other cylinder of the same rolling stand, obtaining on the oblong metal material a condition of balance between sliding and a different mechanical action of deformation in correspondence of the portion in contact with the first rolling cylinder controlled by the first motor (1) with respect to the conditions in correspondence of the portion in contact with the second rolling cylinder controlled by the second motor (11), in favour of the quality and of the mechanical characteristics of the finished product. For example, in addition to the compensation for the wear of the channel of the cylinders that is obtained by the variation in the reciprocal distance of the cylinders, there may be a compensation for the wear of the channel of the cylinders obtained by means of the introduction of a difference in the rotation speed of a cylinder with respect to the other, which is not possible with the rolling stands of the prior art, provided with one single motor, and which is instead possible with the solution according to the present invention in which each cylinder is controllable in an independent way by means of the respective motor. As a consequence there may also be an extension of the useful life cycle of the rolling cylinders thanks to the increased possibilities of compensation provided by the solution according to the present invention.

Therefore, the solution according to the present invention provides the supply of a rolling station (20) intended to couple with a respective rolling cartridge or stand (9) that is provided with two rolling cylinders (31) identical to each other, a first cylinder being provided with at least one first semi-channel and a second cylinder being provided with at least one second semi-channel, the reciprocal placing side-by-side of the cylinders (31) involving the reciprocal placing side-by-side of the at least one first semi-channel and of the at least one second semi-channel whose ensemble constitutes at least one rolling channel of the cartridge or stand (9), wherein the rolling station (20) includes a supporting frame of the transmissions (7) intended to house a pair of transmission devices of which a first transmission device (3) is intended to couple with a first rolling cylinder of the cartridge or stand (9) and a second transmission device (33) is intended to couple with a second rolling cylinder of the cartridge or stand (9), the first rolling cylinder being put in rotation by a first motor (1) by means of the first transmission device (3) and the second rolling cylinder being put in rotation by a second motor (11) by means of the second transmission device (33).

The first motor (1) and the second motor (11) can be controllable in an independent way of each other and/or in a coordinated way with each other. For example one can provide an independent control of a motor with respect to the other, or one can provide the control of one motor only with the other motor that follows the control performed on the first motor with the introduction of a possible speed difference between the first motor (1) and the second motor (11), which can be null or assume a determined difference value calculated in an absolute way or in a percentage way with respect to the speed of the first motor (1). In general the first motor (1) and the second motor (11) are controllable in an independent way of each other with different rotation speeds, the rotation speed difference of the first motor (1) and of the second motor (11) corresponding to a rotation speed difference of the first cylinder with respect to the rotation speed of the second cylinder of the two cylinders (31) of the stand or cartridge (9). For example the rotation speed difference of the first motor (1) and of the second motor (11) is controllable in a manually and/or automatically controlled way according to rolling parameters, such as:

- temperature of the oblong metal material;
- temperature differences between a first oblong metal material rolled in the rolling line and a second oblong metal material rolled in the rolling line after the first;
- temperature differences of the cylinders following the progressive heating of the latter following the rolling process;
- temperature of a portion of the oblong metal material detected by means of temperature detection means in order to compensate for the greater rolling effort required in correspondence of portions having a lower temperature and/or the lower rolling effort required in correspondence of portions having a greater temperature with respect to adjacent portions along a same oblong metal material bar;
- unevenness of the oblong metal material, such as temperature, section, mechanical structure unevenness, etc.;
- unevenness of the oblong metal material detected by means of the input from the first motor (1) and/or second motor (11) and/or differences between them;
- physical and/or mechanical characteristics of the head and/or of the tail of the oblong metal material
- material constituting the oblong metal material that is rolled;
- material for making the cylinders (31);
- wear of the rolling channel;
- one or more measurements of the section of the oblong metal material taken in one or more points of the rolling line;
- tension applied to the oblong metal material between a pair of rolling stations (20);
- combination of one or more of the described parameters.

In correspondence of the first motor (1) a first safety joint (2) is installed and in correspondence of the second motor (11) a second safety joint (12) is installed.

The safety joints have the function of protecting the mechanical transmission in case of cobbles, that is to say, when the rolled product gets blocked inside the rolling cartridge due to operation errors or to problems of various nature that can occur above all during the starting of the plant, that is to say, when the plant is in a test phase. In case of a sudden block of the stand, the mechanical transmission may undergo such high shocks as to damage some components. For this reason a joint with a device is usually introduced, set at a predetermined torque value, which is released when the safety threshold is reached disconnecting the motor from the rest of the transmission. The release device can be of various nature, such as with elements that break, with friction discs, of the hydraulic type, etc. In the prior art solutions said function is performed (FIG. 16) by the toothed joint (26). Advantageously in the solution according to the present invention the application of the safety joint is carried out in a more protected position.

The present invention also relates to a rolling mill plant for the production of oblong metal products comprising at least one rolling station (20) as previously described.

Furthermore, this invention relates to a rolling process for the production of oblong metal products by means of successive passages within a sequence of rolling cartridges or stands (9) of a rolling line comprising rolling stations (20) each of which is intended to house a rolling cartridge or stand (9), in which at least one rolling cartridge or stand (9) is provided with two rolling cylinders (31), a first cylinder of the two cylinders (31) being provided with at least one first semi-channel and a second cylinder of the two cylinders (31) being provided with at least one second semi-channel, the reciprocal placing side-by-side of the two cylinders (31) involving the reciprocal placing side-by-side of the at least one first semi-channel and the at least one second semi-channel which together in their side-by-side configuration form at least one rolling channel of the cartridge or stand (9) intended for the mechanical working by rolling of an oblong metal product passing in said at least one rolling channel in which the rolling process comprises at least one phase of adjustment of the rotation speed difference between the first cylinder and the second cylinder of these two cylinders (31) installed on a same rolling cartridge or stand (9), the first cylinder and the second cylinder of these two cylinders (31) being controllable in rotation in an independent way of each other by means of a pair of transmission devices of which a first transmission device (3) is intended to couple with the first rolling cylinder of the cartridge or stand (9) and a second transmission device (33) is intended to couple with the second rolling cylinder of the cartridge or stand (9), the first rolling cylinder being put in rotation by a first motor (1) by means of the first transmission device (3) and the second rolling cylinder being put in rotation by a second motor (11) by means of the second transmission device (33). Furthermore, said rotation speed difference between the first cylinder and second cylinder is controllable in a manually and/or automatically controlled way according to rolling parameters.

Of course all this must be understood as further advantageous as it is well known that the wear of the materials, in particular of the opposed cylinders, occurs even if imperceptibly in a different way. Therefore, even very small variations in the diameter between the cylinders due to the natural and continuously variable wear implies different peripheral speeds, therefore by the present invention by obtaining the possibility of variation in the angular speed of a cylinder with respect to the other an extremely optimal rolling is obtained with an increase in quality, profitability and productivity.

The description of the present invention has been made with reference to the enclosed figures in a preferred embodiment, but it is evident that many possible changes, modifications and variations will be immediately clear to those skilled in the art in the light of the previous description. Thus, it must be underlined that the invention is not limited to the previous description, but includes all the changes, modifications and variations in accordance with the appended claims.

Nomenclature Used

With reference to the identification numbers in the enclosed figures, the following nomenclature has been used:

1. First electric motor
2. First safety joint
3. Transmission device
4. Guide of the transmission
5. Locking means of the transmission
6. Supporting compensator of the transmission
7. Supporting frame of the transmissions
8. Guides of the frame
9. Rolling cartridge
10. Anchorage frame
11. Second electric motor
12. Second safety joint
13. Epicyclic reduction gear
14. Fourth self-balanced pinion
15. First crown
16. Second torque division pinion
17. First output pinion
18. Hub
19. Transmission slot
20. Rolling station
21. Second crown
22. Third torque division pinion
23. First helical gear
24. Second helical gear
25. Single motor
26. Toothed joint
27. Reducer with two output shafts
28. Adapter
29. Adapters support
30. Adjustment reducer of the cylinders
31. Cylinder
32. Foundations
33. Second transmission device
34. Guides of the stand
35. First input shaft
36. First stage
37. First planetary gear
38. First planetary-gears support
39. Second shaft
40. Second stage
41. Second planetary gear
42. Second planetary-gears support
43. Third shaft

The invention claimed is:

1. An assembly comprising:

a rolling stand having a first rolling cylinder and a second rolling cylinder that rotate in opposite directions, said first rolling cylinder being driven by a first motor by way of a first transmission, said second rolling cylinder being driven by a second motor by way of a second transmission; and a rolling station comprising:

a supporting frame that houses said first and second transmissions and supports said first and second transmissions without a universal joint adapter, said first transmission having a chain of gears directly coupled to an output shaft of said first motor without a universal adapter, said second transmission having a chain of gears directly coupled to an output shaft of said second motor without a universal adapter, each of said first transmission and said second transmission having a first output pinion with a transmission slot, said transmission slot engaging a hub of one of the first and second rolling cylinders, said first and second rolling cylinders positioned in side-by-side relationship, said first output pinion being controlled in rotation by a first torque division pinion that is integral with a first crown, said first output pinion also controlled in rotation by a second torque division pinion that is integral with a second crown, a combined and coordinated action of said first and second torque division pinions controlling the rotation of said first output pinion, said first and second crowns being rotatable by a fourth pinion, said fourth pinion having a first toothed band that is a first gear that transmits motion to said first crown and a second toothed band that is a second gear that transmits motion to said second crown.

2. The assembly of claim 1, wherein said first motor and said second motor are controllable independently of each other.

3. The assembly of claim 2, wherein said first motor and said second motor are controllable independently of each other with different rotation speeds, a rotation speed difference of said first motor and said second motor corresponding to a rotation speed difference of said first rolling cylinder with respect to a rotation speed of said second rolling cylinder.

4. The assembly of claim 3, wherein the rotation speed difference of said first motor and said second motor is controllable in a manual or automatic manner according to rolling parameters.

5. The assembly of claim 1, wherein said first gear and said second gear are respectively a first helical gear shaped with a first screw and a second helical gear shaped with a second screw, wherein the first screw has a shape opposed to a shape of the respective teeth of said first helical gear being oriented at an opposite orientation with respect to an orientation of teeth of said second helical gear.

6. The assembly of claim 1, wherein said fourth pinion receives the rotational motion from one of said first motor and said second motor with an interposition of an epicyclic reduction gear.

7. The assembly of claim 6, wherein said epicyclic reduction gear has a first stage on which a first input shaft engages, said first input shaft acting on first planetary gears of said first stage, which are rotationally supported by a first planetary gear support which provides rotation to a second shaft, said second shaft transmitting a rotational motion from said first stage to a second stage, said second shaft acting on second planetary gears of said second stage, said second planetary gear being rotationally supported by a second planetary gear support which rotates a third shaft, said third shaft coupled to said fourth pinion.

8. The assembly of claim 1, wherein said first and second transmissions are mobilized by a sliding movement on said supporting frame by guides of said first and second transmissions.

9. The assembly of claim 8, said first transmission and said second transmission are suspended from said supporting frame, wherein a supporting compensator self-balances a movement of said first transmission with respect to said second transmission.

10. The assembly of claim 9, wherein said supporting compensator comprises three levers, of which:

a central lever is hinged on said supporting frame in correspondence to a midpoint between a first end and a second end of said central lever;

a first transmission lever is hinged at the first end of said central lever and on which a first element of a locking devices acts; and a second transmission lever is hinged at the second end of said central lever and on which a second element of the locking device acts, an adjustment of position of said first transmission and said second transmission being reciprocally coordinated by said supporting compensator, said first transmission and said second transmission being suspended from said supporting frame by said supporting compensator.

11. The assembly of claim 10, wherein locking device is a hydraulic lock.

12. The assembly of claim 8, wherein a hydraulic actuator drives the movement of said first transmission or said second transmission.

13. The assembly of claim 8, wherein a mechanical actuator drives the movement of said first transmission or said second transmission.

14. The assembly of claim 1, wherein an anchorage frame has frame guides cooperative with said supporting frame so as to allow movement of said supporting frame.

15. The assembly of claim 14, wherein said frame guides are movable in relation to a driven condition of said rolling stand.

16. A rolling process using the assembly of claim 1, wherein said first rolling cylinder has a rotational speed and said second rolling cylinder has another rotational speed, the rolling process comprising:

adjusting a rotational speed difference between the rotational speeds of said first rolling cylinder and said second rolling cylinder; and independently controlling the rotation of said first rolling cylinder and said second rolling cylinder by said first transmission and said second transmission.

* * * * *